US006726306B2

(12) United States Patent
Keyes et al.

(10) Patent No.: US 6,726,306 B2
(45) Date of Patent: Apr. 27, 2004

(54) PRINT HEAD SHUTTER

(75) Inventors: Michael Walter Keyes, Boise, ID (US); David A. Bradley, Jr., Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/192,342

(22) Filed: Jul. 10, 2002

(65) Prior Publication Data

US 2004/0008235 A1 Jan. 15, 2004

(51) Int. Cl.[7] ..... B41J 2/165
(52) U.S. Cl. ..... 347/32
(58) Field of Search ..... 347/4, 23, 29, 347/32, 44, 136; 101/233, 234; 209/3.3; 396/401; B41J 2/165

(56) References Cited

U.S. PATENT DOCUMENTS 4,559,543 A * 12/1985 Toganoh et al. ..... 347/32
4,646,111 A * 2/1987 Shimosato et al. ..... 347/32
4,814,795 A * 3/1989 Kuester et al. ..... 347/8
5,040,000 A * 8/1991 Yokoi ..... 347/30
5,363,132 A * 11/1994 Ikkatai ..... 347/8
5,677,715 A * 10/1997 Beck ..... 347/29
5,701,145 A * 12/1997 Ninomiya ..... 347/23
5,715,492 A 2/1998 Stephenson ..... 396/429
5,717,443 A * 2/1998 Numata et al. ..... 347/16
5,936,652 A * 8/1999 Narayan et al. ..... 347/136
6,015,211 A 1/2000 Kinoshita et al. ..... 347/109
6,142,602 A * 11/2000 Tanaka ..... 347/29
6,309,044 B1 10/2001 Gaarder ..... 347/32
6,416,160 B1 * 7/2002 Silverbrook ..... 347/32

* cited by examiner

*Primary Examiner*—Juanita Stephens
*Assistant Examiner*—Blaise Mouttet

(57) ABSTRACT

A shutter for a print head of a print cartridge is provided. The shutter includes a cover movably attachable to the print cartridge. The cover is movable between a closed position to cover the print head and an open position to expose the print head. An arm is pivotally attachable to the print cartridge and is movably attached to the cover. A biasing device for biasing the cover in the closed position is attached to the arm and is attachable to the print cartridge.

23 Claims, 4 Drawing Sheets

PRINT HEAD SHUTTER

FIELD OF THE INVENTION

The present invention relates generally to shutters for print heads.

BACKGROUND

Many imaging devices used to print labels on objects, such as cartons, boxes, or the like employ a stationary inkjet print cartridge having a print head. Printing is accomplished by moving the object past the print head so that the print head deposits an image on the object by spraying ink through a number of nozzles in the print head onto the object. However, when the print head is not being used, many inks dry out, clogging the nozzles. For imaging devices, such as desktop printers, having movable print heads that move over a stationary printable medium during printing, the print cartridge and thus the print head is moved to a location where the print head is covered to prevent the ink from drying out and clogging the nozzles when the imaging device is not in use. However, by design stationary print heads cannot be moved to a location for covering the print head.

For the reasons stated above, and for other reasons stated below that will become apparent to those skilled in the art upon reading and understanding the present specification, there is a need in the art for preventing inks from drying out and clogging the nozzles of the print heads of stationary print cartridges.

SUMMARY

One embodiment of the present invention provides a shutter for a print head of a print cartridge. The shutter includes a cover movably attachable to the print cartridge. The cover is movable between a closed position to cover the print head and an open position to expose the print head. An arm is pivotally attachable to the print cartridge and is movably attached to the cover. A biasing device for biasing the cover in the closed position is attached to the arm and is attachable to the print cartridge.

In another embodiment, a print cartridge is provided. The print cartridge includes a body and a print head. A cover is movably attached to the body. The cover is movable within a plane substantially parallel to the print head between a closed position to cover the print head and an open position to expose the print head. An arm is pivotally attached to the body and is movably attached to the cover for moving the cover between the closed and open positions. A biasing device is attached to the arm and the body for biasing the cover in the closed position.

Further embodiments of the invention include methods and apparatus of varying scope.

DETAILED DESCRIPTION

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

Figure 1:
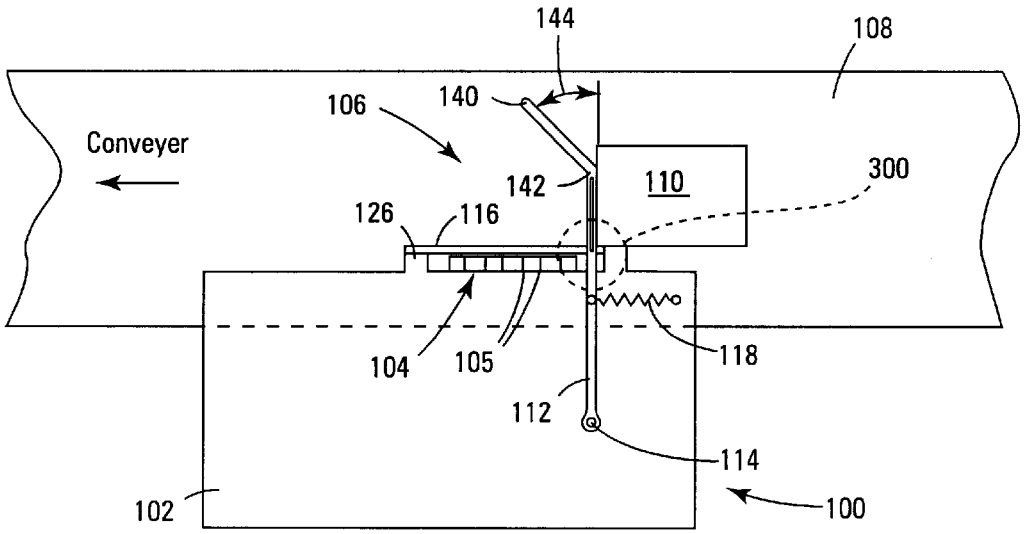
FIG. 1 is a plan view of a print cartridge according to an embodiment of the present invention.
Figure 2:
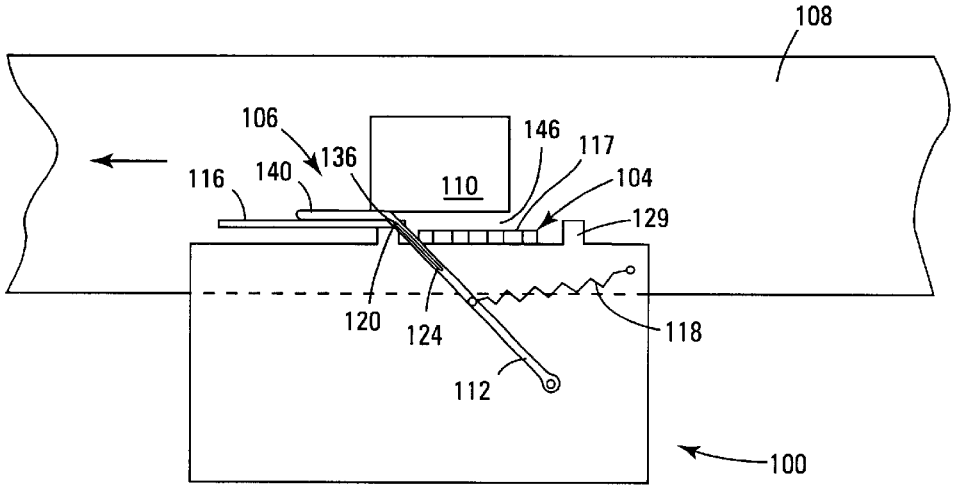
FIG. 2 is a plan view of the print cartridge of FIG. 1 illustrating exposure of a print head of the print cartridge according to another embodiment of the present invention.

FIG. 1 is a plan view of a print cartridge 100 according to an embodiment of the present invention. Print cartridge 100 includes a cartridge body 102 and a print head 104 or other marking device for depositing an image on a moving object, e.g. object 110. In one embodiment, print cartridge 100 is an inkjet cartridge and print head 104 includes a number of nozzles 105. Print cartridge 100 includes a shutter 106 or the like, for covering and uncovering print head 104. Shutter 106 is closed to cover print head 104 when print head 104 is not in use. This prevents ink of cartridge 100 from drying out and potentially clogging nozzles 105 of print head 104. A conveyer 108, such as a moving belt or the like, conveys object 110, e.g., a box, carton, or the like past print cartridge 100. Object 110 engages shutter 106 and moves shutter 106 from the closed position to an open position, as shown in FIG. 2, where print head 104 is exposed for printing on object 110 as object 110 movies past print cartridge 100. After object 110 moves out of engagement with shutter 106, shutter 106 automatically returns to the closed position.

More specifically, shutter 106 includes an arm 112 movably attached to a cover 116 of shutter 106 for moving cover 116 between the closed position shown in FIG. 1 and the open position shown in FIG. 2. In one embodiment, arm 112 is pivotally attached to cartridge body 102 by a pivot 114, such as a pin. Cover 116 is movable between the closed position to cover print head 104 and the open position to expose print head 104. In another embodiment, cover 116 is movable within a plane substantially parallel to a face plane 117 (shown in FIG. 2) of print head 104. Shutter 106 also includes a biasing device 118 connected between arm 112 and cartridge body 102 for automatically returning cover 116 to the closed position after object 110 moves out of engagement with arm 112. In one embodiment, biasing device is a spring, an elastic strip, or the like. Biasing device 118 biases cover 116 in a closed position, as shown in FIG. 1, so that cover 116 covers print head 104 when print head 104 is not in use to prevent the ink from drying out and potentially clogging nozzles 105 of print head 104.

Figure 3:
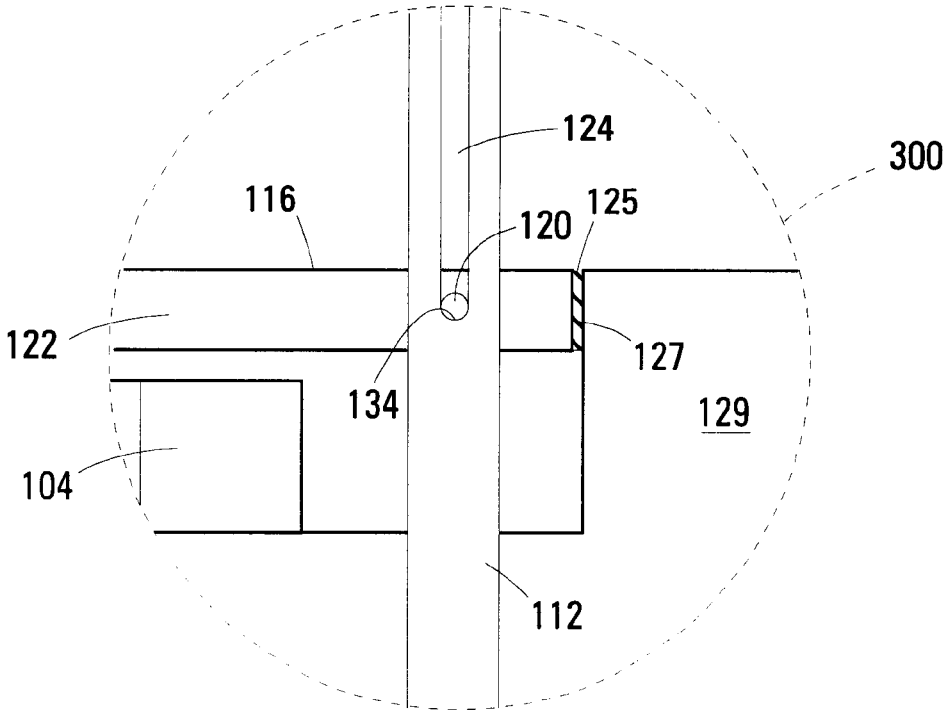
FIG. 3 is an enlarged view of region 300 of FIG. 1.

FIG. 3 is an enlarged view of region 300 of FIG. 1 illustrating attachment of arm 112 to cover 116. In one embodiment, a pin 120 protrudes from an edge 122 of cover 116 and extends into a slot 124 of arm 112. Cover 116 is movably attached to a protrusion 126 of cartridge body 102, e.g., using rollers, slides or the like. Biasing device 118 exerts a force on arm 112 so that arm 112 bears against pin 120 of cover 116 to bias cover 116 in the closed position, as shown in FIGS. 1 and 3.

In one embodiment, a seal 125, e.g., an elastomer or the like, is disposed on an edge 127 of cover 116 substantially perpendicular to edge 122, as shown in FIG. 3. When cover 116 is in the closed position seal 125 abuts protrusion 129 of cartridge 100, reducing exposure of print head 104 to the environment outside cartridge 100, thus helping to prevent the ink of cartridge 100 from drying out and potentially clogging nozzles 105 of print head 104.

Figure 4:
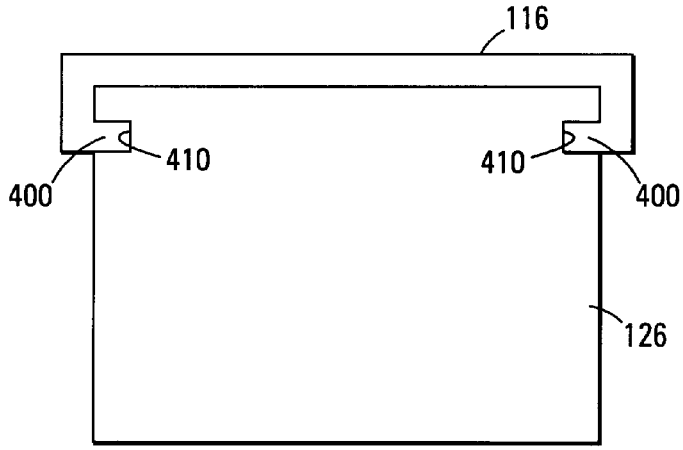
FIG. 4 illustrates slidable attachment of a cover of the print cartridge of FIG. 1 according to another embodiment of the present invention.

FIG. 4 illustrates slidable attachment of cover 116 to protrusion 126 according to another embodiment of the present invention. Rails 400 of cover 116 slide within grooves 410 disposed within protrusion 126. This maintains cover 116 substantially parallel to a face plane 117 of print head 104 as cover 116 slides between the closed and open positions. In one embodiment, rails 400 are integral with cover 116.

Object 110 engages arm 112 and pivots arm 112 about pivot 114 against the biasing force exerted on arm 112 by biasing device 118. As arm 112 pivots, arm 112 exerts a force on cover 116 via pin 120. This moves cover 116 in the direction of motion of object 110 to the open position, as shown in FIG. 2, thereby exposing print head 104. As arm 112 opens cover 116, pin 120 travels within slot 124 of arm 112 so that cover 116 moves substantially parallel to print head 104.

In one embodiment, pin 120 is located adjacent an end 134 of slot 124 when cover 116 is closed, as shown in FIG. 3. In another embodiment, when cover 116 is open, pin 120 is located adjacent an end 136 of slot 124 that is opposite end 132, as shown in FIG. 3. In some embodiments, an extension 140 extends angularly from an end 142 of arm 112 to form an angle 144 with respect to arm 112, as shown in FIG. 1. In one embodiment, angle 144 is such that extension 140 is substantially parallel with face plane 117 of print head 104 and abuts cover 116 when cover 116 is open, as shown in FIG. 2.

Object 110 moves over extension 140 as it moves past print cartridge 100. As object moves past print head 104, ink is sprayed through nozzles 105 of print head 104 onto object 110 to deposit an image on object 110. In one embodiment, a gap 146 separates print head 104 from object 110 during printing, as shown in FIG. 2, and the ink is sprayed across gap 146.

After object 110 moves past and out of engagement with extension 140, biasing device 118 returns arm 112 to the position shown in FIG. 1, thereby closing cover 116. Specifically, biasing device 118 pivots arm 112 about pivot 114, and arm 112 exerts a force on cover 116 via pin 120, causing cover 116 to move counter to the direction of motion of object 110 into the closed position. As arm 112 closes cover 116, pin 120 travels within slot 124 in a direction from end 136 to end 134 so that cover 116 moves substantially parallel to print head 104.

CONCLUSION

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. A shutter for a print head of a print cartridge, comprising:

a cover movably attachable to the print cartridge, the cover movable between a closed position to cover the print head and an open position to expose the print head;

an arm pivotally attachable to the print cartridge and movably attached directly to the cover; and a biasing device for biasing the cover in the closed position, the biasing device attached to the arm and attachable to the print cartridge.

2. The shutter of claim 1, wherein a pin of the cover extends into a slot of the arm to movably attach the arm to the cover.

3. The shutter of claim 1, wherein the biasing device is a spring.

4. The shutter of claim 1, wherein the cover is movable within a plane substantially parallel to a face plane of the print head.

5. The shutter of claim 1, wherein the arm comprises an extension extending at an angle relative to the arm such that when the cover is in the open position the extension is substantially parallel with a face plane of the print head.

6. The shutter of claim 1, wherein the cover comprises a seal.

7. A print cartridge comprising:

a body;

a print head;

a cover movably attached to the body, the cover movable within a plane substantially parallel to a face plane of the print head between a closed position to cover the print head and an open position to expose the print head;

an arm pivotally attached to the body and movably attached to the cover for moving the cover between the closed and open positions; and a biasing device attached to the arm and the body for biasing the cover in the closed position;

wherein the arm is pivotable from a first position corresponding to the closed position of the cover to a second position corresponding to the open position of the cover by an object to be printed upon by the print head as the object moves past the print head during printing.

8. The print cartridge of claim 7, wherein the print head comprises a plurality of nozzles.

9. The shutter of claim 7, wherein the biasing device is a spring.

10. The shutter of claim 7, wherein the cover is slidably attached to the body.

11. A print cartridge comprising:

a body;

a print head;

a cover movably attached to the body, the cover movable within a plane substantially parallel to a face plane of the print head between a closed position to cover the print head and an open position to expose the print head;

an arm pivotally attached to the body and movably attached to the cover by a pin extending from the cover into a slot of the arm, the arm pivotable between a first position corresponding to the cover being in the closed position and a second position corresponding to the cover being in the open position, the arm exerting a force on the pin as the arm pivots between the first and second positions to move the cover between the closed and open positions, the pin traveling within the slot as the arm pivots so that the cover moves within the plane substantially parallel to the face plane of the print head; and a biasing device attached to the arm and the body for biasing the cover in the closed position;

wherein the arm is pivoted pivotable from the first position to the second position by an object to be printed upon by the print head as the object moves past the print head during printing.

12. A method for printing comprising:

moving an object to be printed upon relative to a stationary print head and into contact with a shutter;

moving the shutter from a closed position, where the shutter covers the print head, to an open position, where the print head is exposed, by moving the object against the shutter;

depositing an image on the object using the print head as the object moves relative to the print head; and automatically returning the shutter to the closed position after the object moves out of contact with the shutter.

13. The method of claim 12, wherein moving the shutter comprises the object moving an arm of the shutter so that the arm moves a cover of the shutter from the closed position to the open position.

14. The method of claim 13, wherein automatically returning the shutter to the closed position comprises using a biasing device for biasing the cover in the closed position to move the arm of the shutter so as to move the cover from the open to the closed position.

15. The method of claim 12, wherein depositing an image on the object using the print head comprises the print head spraying ink onto the object across a gap separating the print head from the object.

16. A print cartridge, comprising:

a means for depositing an image on a moving object; and a means for covering and uncovering the image depositing means, wherein the covering and uncovering means uncovers the image depositing means as the object contacts and moves against the covering and uncovering means and automatically covers the image depositing means after the object moves out of contact with the covering and uncovering means.

17. The print cartridge of claim 16, wherein the image depositing means is a print head.

18. The print cartridge of claim 16, wherein the image depositing means comprises nozzles for spraying ink onto the object.

19. The print cartridge of claim 16, wherein the covering and uncovering means comprises a shutter.

20. The print cartridge of claim 16, wherein the covering and uncovering means comprises a cover for covering the image depositing means movably attached to the print cartridge and a means for moving the cover between positions where the cover covers and uncovers the image depositing means.

21. The print cartridge of claim 20, wherein the cover moving means is an arm movably attached to the cover.

22. The print cartridge of claim 20, wherein the covering and uncovering means comprises a means for automatically returning the cover from the position uncovering the image depositing means to the position covering the image depositing means by moving the cover moving means.

23. The print cartridge of claim 22, wherein the automatic cover returning means is a biasing device for biasing the cover in the position covering the image depositing means.

* * * * *

UNITED STATES PATENT AND TRADEMARK OFFICE

CERTIFICATE OF CORRECTION

PATENT NO. : 6,726,306 B2
DATED : April 27, 2004
INVENTOR(S) : Keyes et al.

It is certified that error appears in the above-identified patent and that said Letters Patent is hereby corrected as shown below:

Column 5,
Line 1, delete "pivoted".

Signed and Sealed this

Tenth Day of August, 2004

JON W. DUDAS
*Acting Director of the United States Patent and Trademark Office*